US006932488B1

(12) United States Patent
Horn

(10) Patent No.: US 6,932,488 B1
(45) Date of Patent: Aug. 23, 2005

(54) VANITY LIGHTING SYSTEM

(75) Inventor: Donald N. Horn, Pawlet, VT (US)

(73) Assignee: Dualume Cabinets, Inc., Pawlet, VT (US)

( * ) Notice: Subject to any disclaimer, the term of this patent is extended or adjusted under 35 U.S.C. 154(b) by 75 days.

(21) Appl. No.: 10/792,549

(22) Filed: Mar. 2, 2004

(51) Int. Cl.[7] ..... F21V 33/00
(52) U.S. Cl. ..... 362/128; 362/141; 362/287
(58) Field of Search ..... 362/128, 133, 362/135, 136, 137, 140, 141, 142, 143, 144, 287, 427; 312/223.1, 223.5, 224, 225; 132/288, 291, 316

(56) References Cited

U.S. PATENT DOCUMENTS

| | | | | |
|---|---|---|---|---|
| 1,889,373 A | * | 11/1932 | Pereira | 362/99 |
| 1,930,081 A | * | 10/1933 | Biller | 362/129 |
| 2,014,266 A | * | 9/1935 | Sherbondy | 362/137 |
| 2,198,077 A | * | 4/1940 | Curtis | 362/133 |
| 4,178,626 A | | 12/1979 | Marcus | |
| 4,629,264 A | | 12/1986 | Culver | |
| 4,688,861 A | | 8/1987 | Culver | |
| 4,752,863 A | | 6/1988 | Parrott | |
| 5,057,977 A | | 10/1991 | Kurzman | |
| 6,019,481 A | | 2/2000 | Ambach et al. | |
| 6,164,788 A | | 12/2000 | Gemmell et al. | |
| 6,371,621 B1 | | 4/2002 | Le Bel | |

* cited by examiner

*Primary Examiner*—Y. My Quach-Lee
(74) *Attorney, Agent, or Firm*—Darby & Darby; Michael J. Sweedler; James N. Tuozzo

(57) ABSTRACT

A vanity lighting system for concealing a lighting apparatus when a pivotally mounted cover is closed and positioning the lighting apparatus through movement of the cover as it is opened. The vanity lighting apparatus comprises a housing providing an opening, a mirror; an illumination lamp located within the housing, a cover pivotably movable between a closed position overlaying the opening and an open position at least partially spaced from the opening. The cover encloses the lamp such that when the cover is in the closed position the lamp is hidden from view. Additionally, the vanity lighting apparatus comprises a first support assembly including at least two pivotal points operably coupled with the cover and the lamp and a second support assembly including at least one pivotable point operably coupled with the housing and the lamp, wherein the first and second support assemblies provide movement of the lamp in response to the movement of the cover. An activation means is provided for activating and deactivating the illumination lamp in response to the movement of the cover.

18 Claims, 5 Drawing Sheets

FIG. 5A
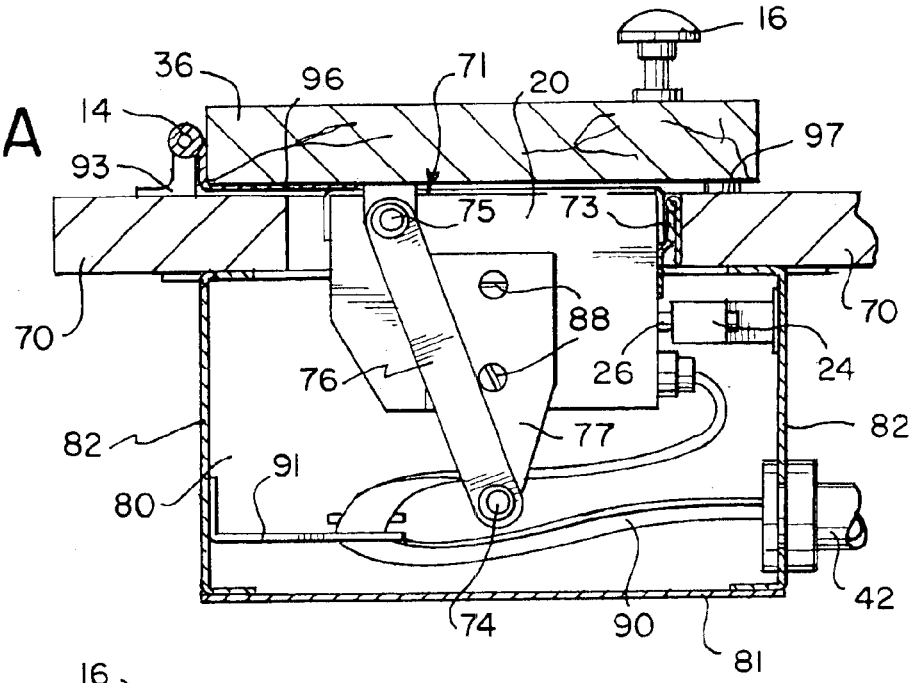
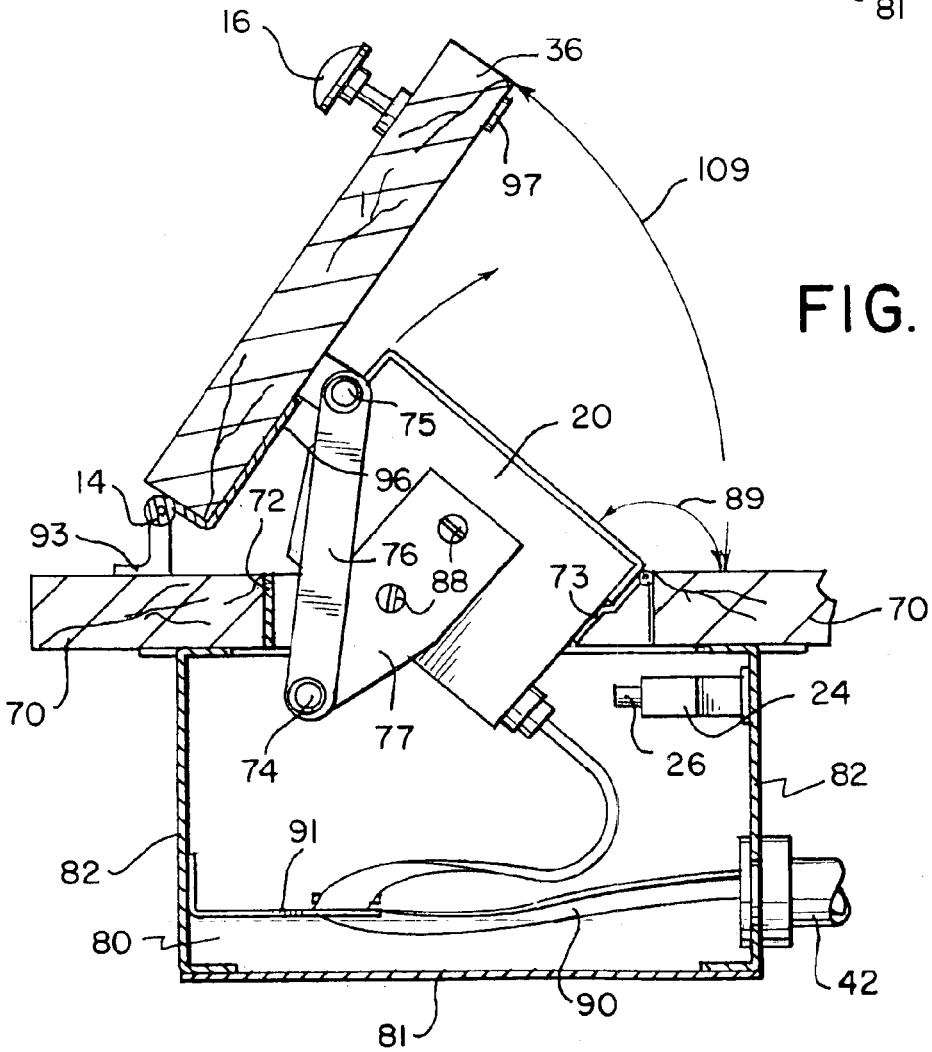
FIG. 5B

FIG. 6A
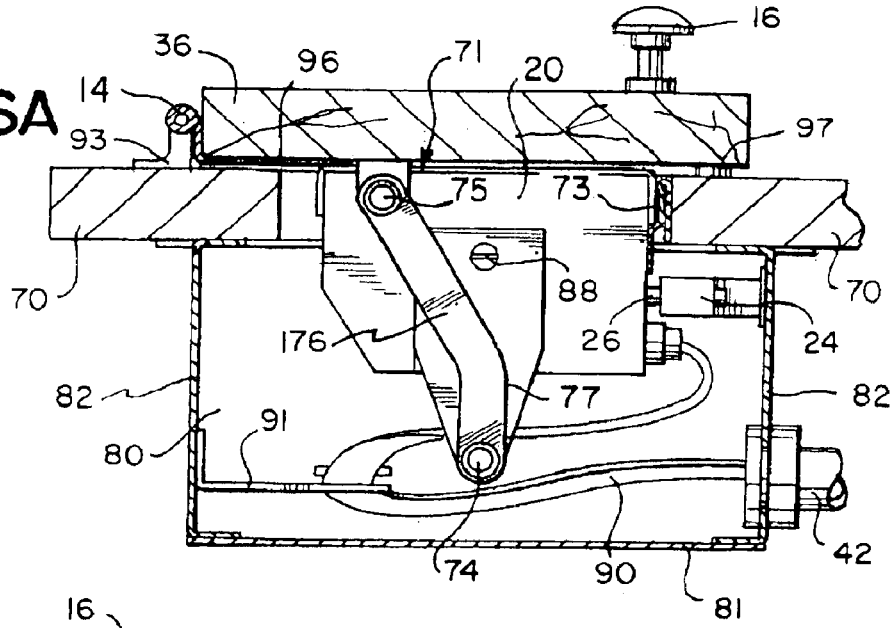
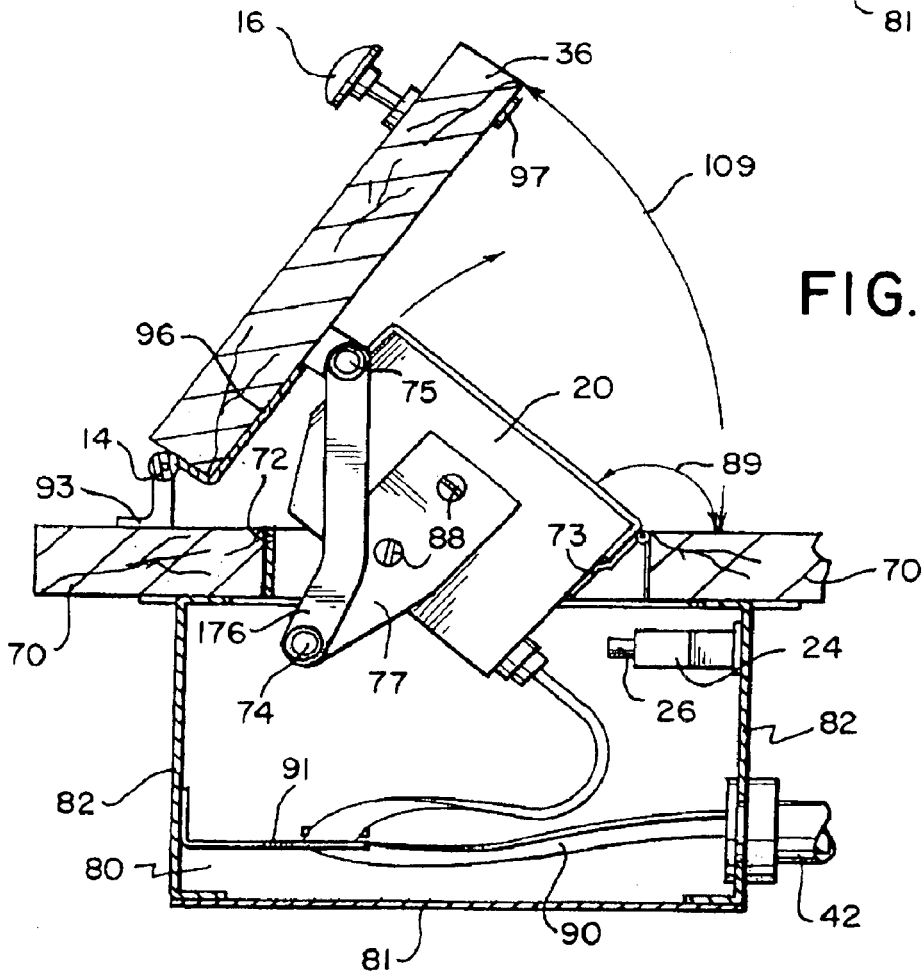
FIG. 6B

VANITY LIGHTING SYSTEM

FIELD OF INVENTION

The present invention relates to lighting structures and, more particularly, to a concealable lighting apparatus for use with a vanity or wall mounted mirror which can be positioned at a plurality of angles with respect to the mirror. This lighting apparatus may be used in a bathroom, dressing room or other area where supplemental light is required.

BACKGROUND OF THE INVENTION

Various lighting arrangements are known for bathrooms and the like. Conventionally, a lighting arrangement is either fixed above, below or at the sides of a wall mounted mirror. These lights are generally exposed at all times or selectively hidden from view by a cover. Various types of vanity cabinet and mirror structures include panels or covers which can be slidably, pivotable, or removably opened to reveal a lighting arrangement for illumination when a person is positioned in front of the cabinet or mirror.

For instance, vanity light apparatus' are shown in U.S. Pat. No. 4,752,863 to Parrott and U.S. Pat. No. 4,629,264 to Culver in which pivotable panels are moved to expose concealed lighting arrangements. In Parrott, a pivotable cover is positionable between a closed and open position. When the cover is in the open position a light source housed within the structure is activated.

In Culver, a vanity cabinet includes a hinged cover and a folding vanity panel hinged to the underside of the cover. A mirror, mirror support and light source, hinged to the vanity panel are hidden from view when the cover is in a close position and are automatically unfolded and swung to an upright viewing position when the cover is raised.

Parrott and Culver suffer from numerous deficiencies making them undesirable from various standpoints. For example, in both Parrott and Culver, adjustment of the position of the light source and its angular alignment with respect to the mirror is severely limited. In Culver the cover is supported in only a fully raised position and while angular adjustment of the mirror is provided with respect to the vertical, no means for adjusting the lighting arrangement is provided. Furthermore, adjustment of the mirror is cumbersome, requiring the loosening of screws which hold the mirror in a fixed position, realigning the mirror and then retightening the screws. Flexibility in Culver is limited as well because none of Culver's structures are designed for wall mounting as units in modem, vanity cabinets.

In Parrott, several embodiments for positioning a rod-shaped light bulb within a housing are disclosed. However, in all Parrott's lighting arrangements, the light bulb is either fixedly attached to a pivotally connected cover or to a stationary back-wall of the housing. Accordingly, it is virtually impossible to control the angle at which the bulb projects light toward the mirror. Parrott, as with Culver, is directed to supporting the cover in only a fully opened or closed position. If Parrott's cover were partially pivoted to a position where the cover was between a fully open and closed position, illumination is limited to the portion of the light source that extends through the housing. It is desirable to be able to adjust the direction or angle of the entire output of the light source rather than limit the visible output of the light source to only a portion of its entire illumination.

SUMMARY OF THE INVENTION

It is a primary object of the present invention to provide a light apparatus which can be either built into a wall or attached thereto, can be used with wall mounted and vanity mirrors, medicine cabinets and the like and provides sufficient light for common tasks such as shaving or applying make-up.

Still another object of the present invention is to provide a light apparatus which can be selectively hidden from view by a cover in order to protect the light apparatus and to improve the appearance of the area around a mirror or vanity cabinet. The lighting system is configured to provide adjustable positioning of the lamp upon opening and closing of the cover.

The present invention is designed to overcome certain problems with prior art vanity lighting systems such as those noted above. This invention includes a vanity lighting system for concealing a lighting apparatus when a pivotally mounted cover is closed and positioning the lighting apparatus through movement of the cover as it is opened. The lighting apparatus includes at least one light bulb and is configured for retention in a viewing position which can be adjusted with movement of the cover. Therefore, adjustment of the lighting apparatus to enhance viewing by different users in different positions from the mirror can be easily achieved.

In a preferred embodiment of the invention, the vanity lighting system includes: a housing providing an opening extending in a plane to be oriented adjacent and parallel to a mirror; an illumination lamp located within the housing; a cover pivotably movable between a closed position overlaying the opening and an open position at least partially spaced from the opening, the cover enclosing the lamp such that when the cover is in the closed position the lamp is hidden from view; a first support assembly including at least two pivotal points operably coupled with the cover and the lamp; a second support assembly including at least one pivotable point operably coupled with the housing's frame and the lamp, wherein the first and second support assemblies provide movement of the lamp in response to the movement of the cover; and activation means for activating and deactivating the illumination lamp in response to the movement of the cover.

The activation means is located on an inner wall of the housing and includes a switch which is engageable with a portion of the lamp when the cover is in the closed position, engagement of the switch with the portion of the lamp causing deactivation of the lamp.

The illumination lamp is completely located within the housing when the cover is in the closed position and at least a portion of the lamp extends outward through the opening of the housing when the cover is in the open position. The lamp is automatically pivoted to extend through the opening and tilt toward the mirror as the cover is moved to the open position, where an angle defining the amount of tilt between a surface of the lamp and the mirror becomes smaller with the opening of the cover.

According to another aspect of the present invention, the lighting system may be controlled by an automatic or manual switch structure connected to an electrical source by wiring which is hidden from view from the front of the vanity cabinet or mirror. Additionally, storage areas may be provided adjacent the lighting system within a cabinet behind the mirror. Also, a front panel (not shown) which overlays the cover panel may be provided with a decorative front to match adjoining cabinetry decor and an additional lamp can be attached to the front or cover panel for providing ambient lighting when the cover is in the closed position. Upon opening of the cover panel, the additional lamp can be controlled to turn-off and the inner, pivotally mounted lamp can be controlled to turn-on.

BRIEF DESCRIPTION OF THE DRAWING FIGURES

FIG. 5A is a cross-sectional view of the vanity lighting system of FIG. 3 along the line 5—5, according to a first embodiment of the present invention, with the cover in a closed position;

FIG. 5B is a cross-sectional view of the vanity lighting system of FIG. 3 along the line 5—5, according to a first embodiment of the present invention, with the cover in an open position;

FIG. 6A is a cross-sectional view of the vanity lighting system of FIG. 3 along the line 5—5, according to a second embodiment of the present invention, with the cover in a closed position; and FIG. 6B is a cross-sectional view of the vanity lighting system of FIG. 3 along the line 5—5 according to a second embodiment of the present invention, with the cover in an open position.;

DETAILED DESCRIPTION OF PREFERRED EMBODIMENTS

The following description is presented to enable any person skilled in the art to make and use the invention. Various modifications to the disclosed embodiments will be readily apparent to those skilled in the art and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
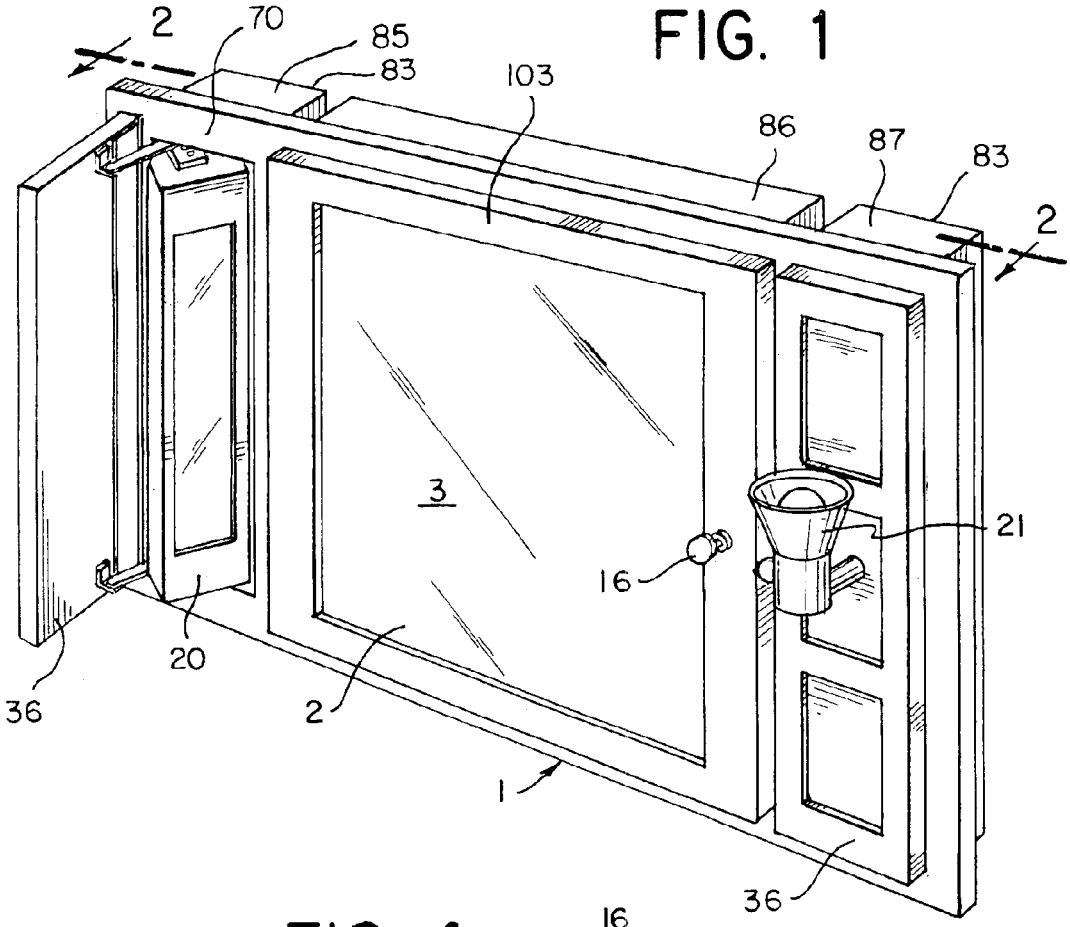
FIG. 1 is a front perspective view showing the vanity lighting system of the present invention located at two sides of a cabinet, a first lighting arrangement having a cover in the opened position and a second lighting arrangement having a cover in the closed position.

The present invention provides an improved vanity lighting system. As shown in FIG. 1, one arrangement of a vanity lighting system includes lamp 20 located at the side of a mirror 2. Alternatively, this lamp may be located at the top or bottom of mirror 2 and mirror 2 may be planar or curved for magnification. Numeral 3 indicates the front face of mirror 2 and will be used hereinafter to reference this front face. An additional lamp 21, fixedly attached to an outer surface of a cover panel 36, provides ambient lighting when cover 36 is in a closed position and can be controlled to turn on and off upon closing and opening of cover 36 as described below.

According to a preferred embodiment FIGS. 5A and 5B show the vanity lighting system broken out of the vanity cabinet. As shown, lamp 20 is pivotally connected to a frame 70 and the cover panel or door 36. Cover 36 is pivotally mounted to frame 70 by a first pivoting structure (pivot 14) for movement between open and closed positions in overlying relationship to frame 70. Pivot 14 includes first and second hinge parts, 93 and 96, connected to the housing and cover respectively, with a hinge pin interconnecting the hinge parts. The second hinge part connected with the cover is operable to translate during the movement of the cover. Instead of using pivot 14 as is shown in FIGS. 5A and 5B, any other conventional connection means may be used to connect the cover 36 and frame 70 such that it provides for pivotal movement of the cover.

Pivot 14 is included for pivoting cover 36 with respect to frame 70 from a closed, substantially flush, position to an open position in which lamp 20 can be exposed to provide illumination. A support assembly 71 is provided for attaching lamp 20 to cover 36 and frame 70. Support Assembly 71 includes second, third and forth pivoting structures, pivots 73, 74 and 75, respectively and arms 76 and 77 for selectively positioning lighting emitting means 20 at an angle 89 (FIG. 5B) with respect to frame 70 (and subsequently mirror 2). Screws 88 are provided for supporting lamp 20 on arm 77. Referring to FIG. 5B, as cover 36 pivots outward (counter-clockwise), lamp 20 is automatically pivoted outward toward mirror 2 (not shown) by the simultaneous action of pivots 73–75 and arms 76 and 77. The more cover 36 is moved outward from the closed position, the greater angle 109 (between the cover and the mirror) will become, the more pivots 73–75 pivot lamp 20 toward mirror 2 and the smaller angle 89 (between the lamp and the mirror) will become. Accordingly, angles 89 and 109 are inversely proportional to each other during the movement of cover 36 and support assembly 71, while movably securing lamp 20 to cover 36 and frame 70, provides a structure for selectively positioning lamp 20 at a desired angle 89 with respect to mirror 2.

In response to movement of cover 36, pivots 74 and 75 pivot in opposite directions, e.g., if pivot 74 pivots clockwise then pivot 75 pivots counter-clockwise and vise versa. Pivots 14 and 73 also pivot in opposite directions in response to movement of cover 36, and as such, as cover 36 rotates counter-clockwise about pivot 14, lamp 20 rotates clockwise about pivot 73.

Referring to FIG. 5A, when the cover 36 is in the closed position, lamp 20, bottom and top panels 80, 83, upstanding rear and side panels, 81 and 82 respectively (FIG. 3), and support assembly 71 are hidden from view from a person standing in front of mirror 2 and lamp 20 is completely located within housing 85. Thus, a person looking at the front reflective face 3 of mirror 2 would be unable to see lamp 20. Accordingly, a more attractive appearance is obtained through the use of cover 36. The person standing in front of mirror 2 may then open cover 36 by grasping handle 16, or by a groove in cover 36 or by any other conventional grasping arrangement or even by mere frictional force along an edge of the cover 36.

According to a preferred embodiment, panels 80–83, frame 70 and cover 36 are shown incorporating wood. However, panels 80–83, frame 70 and cover 36 may be alternatively formed from particle board, molded plastic or the like and finished or covered as desired with plastic laminate sheeting, synthetic countertop materials, wood veneers, or other finishes and coverings as desired.

As the cover 36 is moved from the closed position against frame 70 to the open position as shown in FIG. 5B, lamp 20 pivots about pivot 73, cover 36 pivots about pivot 14 and arms 76 and 77 of support assembly 71 pivot about pivot 74. This partially raises lamp 20 outward from housing 85 to the exposed position as shown in FIG. 5B. As shown, lamp 20 is partially exposed from the housing and tilted toward mirror 3 at angle 89 when the cover is moved to the open position. Thus, light from the lamp is able to project outward from the housing.

In order to provide automatic activation of lamp 20, an activation device 24 incorporating a normally closed contact switch 26 is secured to an inner surface of side panel 82 which is configured to engage a sidewall of lamp 20. Pivoting cover 36 in the counter-clockwise direction away from frame 70 releases contact switch 26 to close the switch and turn on lamp 20. Thus, when cover 36 is in the open position and lamp 20 is exposed, the light bulb 22 will be activated. Conversely, when cover 36 is closed, switch 26 is opened to deactivate lamp 20. External light apparatus 21 can be connected to activation device 24 and controlled thereby as discussed above with respect to lamp 20. Alternately, external light apparatus 21 may be controlled by a second activation device, separate from device 24, or can be manual control can be provided by an external switch accessible to the user. Alternately, a manual switch (not shown) can be substituted on the front of the vanity, e.g., frame 70, covers 36 or 103 etc., for activating and deactivating lamp 20.

As cover 36 pivots to the open position, contact between switch 26 and lamp 20 is broken. Due to the arrangement of pivots 73–75 and their connection with cover 36 and frame 70, angle 89 between the front face of lamp 20 and the front reflective face 3 of mirror 2 can be easily and safely adjusted by moving cover 36. Accordingly, a person standing in front of mirror 2 can adjust the direction of illumination according to their particular viewing position, e.g., to compensate for the person's distance from, or to the side of, mirror 2. Furthermore, as the person changes his or her position from mirror 2, additional adjustments can be me made quickly by further movement of cover 36 in the clockwise or counter-clockwise direction through angle 109. This can increase the available light to the user according to his or her position with respect to mirror 2 and provides a user the ability to make adjustment for better visibility from any location in the vicinity of mirror 2.

Figure 3:
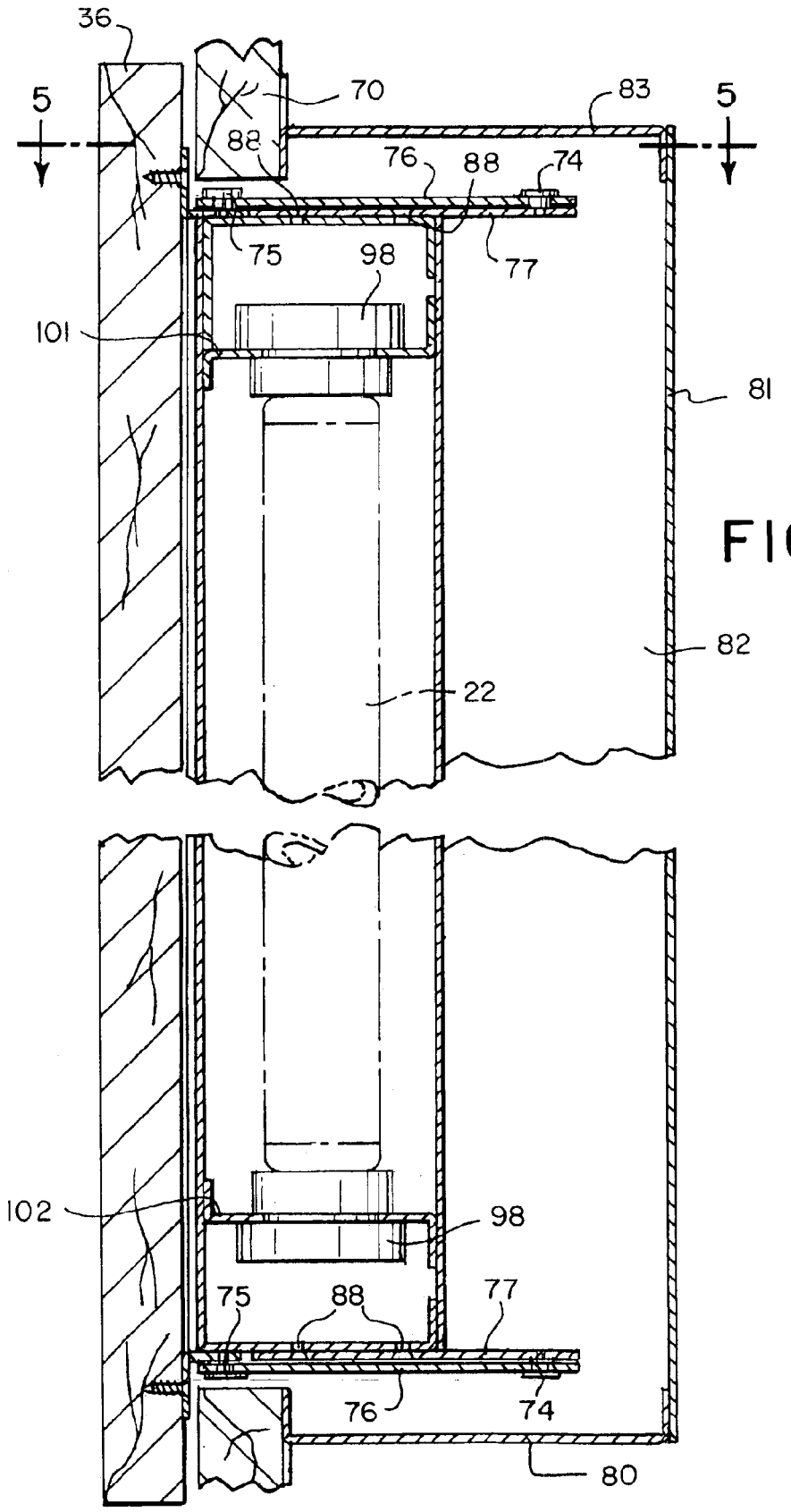
FIG. 3 is a cross-sectional view of the vanity lighting system of FIG. 2 along the line 3—3.

Referring to FIG. 1, cover 36, light emitting aperture 20 and frame 70 are shown in relation to a mirror 2. As discussed above, when cover 36 is in the closed position, lamp 20 is hidden from view. However, as shown, when this cover is moved to the open position, lamp 20 is visible and is able to emit light toward of mirror 2 at a preferred angle 89. Referring to FIG. 3, lamp 20 includes two fluorescent-type bulb receptacles 98 for securing and electrically connecting fluorescent bulb 22 within the light apparatus. Bulb receptacles 98 are affixed to top and bottom inner walls 101, 102 of lamp 20. While a fluorescent-type bulb is indicated for use with lamp 20, any conventional lighting means, including an incandescent bulb, may be used. Lamp 20 is preferably configured for use with one bulb 22, however, according to a salient arrangement of present invention lamp 20 can be configured for use with a variety of illumination needs by including additional bulb receptacles 98 for supporting additional bulbs 22.

Although FIG. 1 indicates that the vanity lighting system is integral with mirror 2, this vanity lighting system may be provided without any cabinet or mirror structure and may be used in various additional scenarios requiring concealable lighting, i.e., showcasing artwork, jewelry, etc. Also, this lighting system may be built into the wall or mounted on the wall in the vicinity of a wall mounted mirror. Built-in arrangements have the benefit of being more attractive as they are flush with the mirror, it is therefore more difficult to detect that a light apparatus is provided and the appearance of the area around the mirror is improved. This light apparatus may merely be mounted on the wall rather than built-in, however, the built-in arrangements nonetheless provide for an attractive appearance of the area surrounding mirror 2.

In FIG. 1, the wall (not shown) on which vanity assembly 1 is mounted may have a recess therein for receiving housings 85–87. The height of rear and side panels, 81 and 82, respectively, and/or the depth of top and bottom panels 80–83 may be increased to provide housing 85–87 with additional space to receive alternate lamp' 20 of varying sizes. It should be understood that housing 86 can function as a storage area for the vanity system. Accordingly, housing 86 can be used to house toilet articles, spare light bulbs or the like and is accessible when front panel 103 is opened by knob 16.

As discussed above with reference to FIGS. 5A and 5B, a vanity lighting system according to a preferred embodiment of the present invention includes an activation device 24 which can be either mounted on pivoting cover 36, frame 70 or affixed to stationary side wall 82 of the housing 85. According to a preferred embodiment, activation device 24 is fixedly attached to side panel 82 and includes a switch 26 which engages a side wall of lamp 20.

When a user opens cover 36, pivoting the cover counter-clockwise about pivot 14 (FIG. 5B), lamp 20 turns on. To turn-off lamp 20 and to hide it from view, cover 36 is pivoted clockwise (FIG. 5A) about pivot 14 to the closed position. Stops, links, the sheer frictional force of the pivot, or other means can be provided to limit the angle 109 through which cover 36 opens, angle 89 through which a front face lamp 20 approaches mirror 2 and to protect frame 70 on repeated opening of the cover. Referring to FIG. 5B, a stop 72 of predetermined thickness is shown fixedly attached to frame 70. As cover 36 is opened angle 109 increases, angle 89 decreases, and a surface of lamp 20 or arms 76 and 77 will contact stop 72 preventing further counter clockwise movement of the cover. One of ordinary skill in the art will release that stop 72 is not essential and can be provided as necessary to prevent the movement of cover 36 and lamp 20 past predetermined angular values or to protect an edge of frame 70 from wear and tear resulting from contact with portions of light apparatus 20 or support assembly 71. Additionally, a wooden or rubber support block 97 is shown secured on the undersurface of cover 36 in line with a front face of frame 70 which has a thickness substantially the same or twice that of second hinge part 96 used for attaching cover 36 to pivot 14. Support block 97 engages frame 70 when cover 36 is in the closed position as shown in FIG. 5A such that cover 36 is generally parallel with frame 70 when in its closed position and can provide a means for cushioning and/or silencing cover 36 as it is contacted with frame 70.

A reflective surface (not shown) may be provided to the inner surface of cover 36 such that when cover 36 is moved to the open position, light from lamp 20 is reflected toward mirror 2 by the reflective surface. It is noted that the light in the area of mirror 2 would be increased by lamp 20 whether or not a reflective surface is used. Thus, this reflective surface is optional and merely provides an additional means for directing light from lamp 20.

Figure 4:
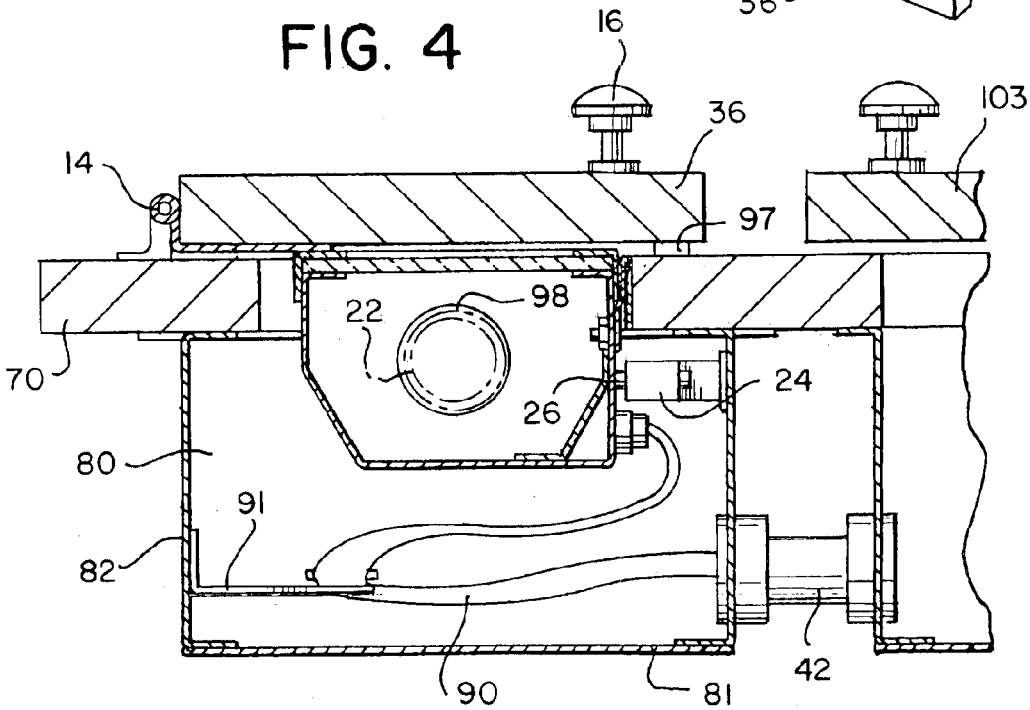
FIG. 4 is a cross-sectional view of the vanity lighting system of FIG. 2 along the line 4—4.

Referring to FIGS. 4, 5A and 5B, a wiring conduit 42 extends through the thickness of side panel 82 allowing wire 90 to travel from lamp 20 to an appropriate ballast and power source. A retaining clip 91 is fastened to the inner side wall of panel 82 to support wire 90 and prevent the wiring from contacting support assembly 71 and/or otherwise tangling. Electrical wiring 90 extends horizontally from support clip 91 through conduit 42 and out of housing 85 for connection to a conventional ballast 33 (FIG. 2) and building or other electrical system providing conventional 110 Volt alternating electric current. Electrical wire 90 is sufficiently long between clip 91 and lamp 20 to allow lamp 20 to pivot through angle 89 without adding undue tensions on wire 90, clip 91 or lamp 20. It is apparent to one of ordinary skill in art that additional apertures, clips or brackets can be provided throughout vanity assembly 1 to lead wiring from the lamp 20 and/or activation device 24 to the appropriate power source.

Figure 2:
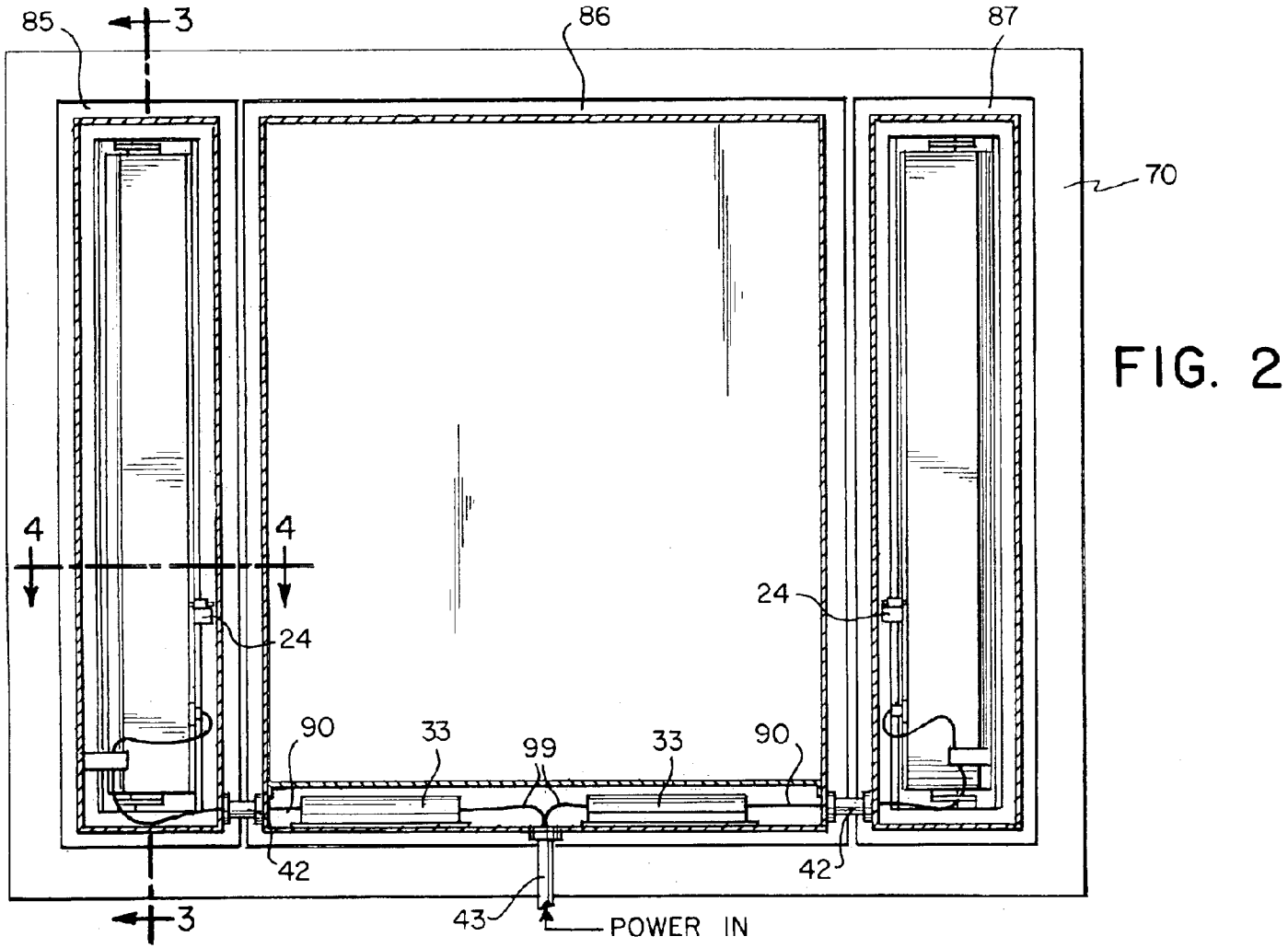
FIG. 2 is a front view of the vanity lighting system of FIG. 1 along the line 2—2 with the cover closed.

Referring to FIG. 2, according to a preferred embodiment, each lamp 20 uses a fluorescent-type bulb 22 and therefore is connected to a conventional electronic ballast 33. It is known that conventional fluorescent fixtures require a ballast to start. Specifically, they increase the voltage high enough to start the fluorescent process and provide several advantages such as starting a fluorescent bulb without flickering, preventing electro-magnetic interference (EMI), starting in very cold weather (down to 50 degrees below 0 for some types) and producing more light while using less power. One of ordinary skill in the art will realize that while ballast 33 is preferably an electronic ballast, any conventional ballast (e.g., a magnetic ballast) can be used.

A ballast 33 is provided for each lamp 20 and as shown can be secured within storage housing 86 of the main vanity cabinet. An additional wiring conduit 43 is provided through a bottom wall of housing 86 for allowing wires 99, exiting each ballast, to travel from the ballasts to an appropriate external power source. In the event that lamps 20 are provided as stand-alone lighting units for use with a preexisting mirror or cabinet, each ballast 33 may be securely mounted to an outside wall of housing 85, 87, or according to an alternative arrangement, housings 85 and 87 can be enlarged to safely and securely house ballasts 33 therein.

In FIGS. 6A and 6B, a second embodiment of the present invention is shown. According to this embodiment, as opposed to being perfectly linear, arm 176 is configured with a bend to allow for increased angular adjustment of lamp 20. The bend in arm 176 also allows for greater opening of cover 36 than is possible with linear arm 76 (FIGS. 5A and 5B). For example, referring to FIG. 5B, angles 89 and 109 are limited by the eventual contact between arm 76 and fame 70, after which further counter-clockwise movement of cover 36 is blocked. Angle 89 at which lamp 20 can be tilted toward mirror 2 is also limited. For illumination needs requiring smaller angles 89 (more tilt of lamp 20), arm 176 is bent, curved or shaped to allow increased pivotal movement of pivots 73–75.

According to a salient aspect of the invention, a locking means may be provided for use with the vanity lighting system in order to ensure that the cover 36 remains flush with frame 70 when it is moved to the closed position. Also, stop means may be provided in order to prevent rotation of cover 36 about hinge 14 beyond a desired angle.

As shown in FIG. 1, typically, when the vanity lighting system is provided as a complete vanity cabinet incorporated with mirror 3 and storage housing 86, frame 70 is configured longer along its top, bottom and sides, extending past housings 85–87. The extending portions of frame 70 are used during installation of the vanity assembly to secure the assembly to the surfaces of a wall which has been pre-carved or cut to accommodate housings 85–87. Securing of the vanity system to the wall may be made by screws, nails, adhesives and the like as is conventionally know in the cabinet or wood-working industry.

The invention being thus described, it will be obvious that the same may be varied in many ways. Such variations are not to be regarded as a departure from the spirit and scope of the invention, and all such modifications as would be obvious to one skilled in the art are intended to be induced within the scope of the following claims.

While the invention has been described with reference to several embodiments thereof, the invention is more broadly defined and limited only by the recitations in the claims appended hereto and their legal equivalents.

I claim:

1. A concealable lighting unit for use with a mirror, comprising:

a housing providing an opening extending in a plane to be oriented adjacent and parallel to the mirror;

an illumination lamp located within the housing;

a cover pivotally movable between a closed position overlaying the opening and an open position at least partially spaced from the opening, the cover enclosing the lamp such that when the cover is in the closed position the lamp is hidden from view;

a first support arm including at least first and second pivotal points, wherein the first pivotal point is operably coupled to the cover;

a second support arm operably coupled to the lamp and the second pivotal point, wherein the first and second support arms provide for movement of the lamp in response to the movement of the cover; and activation means for activating and deactivating the illumination lamp in response to the movement of the cover.

2. The lighting unit of claim 1 wherein the first and second pivotal points pivot in opposite directions in response to the movement of the cover.

3. The lighting unit of claim 1 wherein the second pivotal point pivots in the same direction as the cover opens.

4. The lighting unit of claim 1 wherein the illumination lamp is completely located within the housing when the cover is in the closed position and at least a portion of the lamp extends outward through the opening of the housing when the cover is in the open position.

5. The lighting unit of claim 1 wherein the lamp is partially exposed from the housing, activated and tilted toward the mirror when the cover is moved to the open position thereby allowing light from the lamp to project outward from the housing.

6. The lighting unit of claim 1 wherein the lamp is automatically pivoted to extend through the opening and tilt toward the mirror as the cover is moved to the open position, and an angle defining the amount of tilt between a surface of the lamp and the mirror becomes smaller as the cover opens.

7. The lighting unit of claim 1 wherein the activation means is located on an inner wall of the housing, the activation means comprising a switch which is engageable with a portion of the lamp when the cover is in the closed position, engagement of the switch with the portion of the lamp causing deactivation of the lamp.

8. The lighting unit of claim 1 wherein the first and second support arms allow for selectively positioning said lamp at a plurality of angular positions with respect to the mirror.

9. The lighting unit of claim 1 further comprising electrical wires for connecting the lamp and the activation means to a source of electricity.

10. The lighting unit of claim 1 wherein the first and second pivotal points provide a sheer frictional force operable to maintain the cover's position under forces on the cover that are less than a predetermined amount.

11. The lighting unit of claim 1 further comprising:

a frame attached to the housing;

a hinge connecting the cover to the frame and allowing the cover to pivot relative to the frame.

12. The lighting unit of claim 11 wherein the hinge includes a first hinge part connected to the frame, a second hinge part connected to the cover and a hinge pin interconnecting the first and second hinge parts, wherein the second hinge part is angularly translated by the movement of the cover.

13. The lighting unit of claim 1 wherein:

a first angle is defined between the cover and the mirror when the cover is in the open position;

a second angle is defined between the lamp and the mirror; and the first angle is inversely proportional to the second angle during the movement of the cover.

14. The lighting unit of claim 1 wherein the housing is adapted for placement in a wall.

15. The lighting unit of claim 1 further comprising:

a frame connected between the cover and the housing wherein the frame has an opening that coincides with the opening in the housing; and the frame connects to the housing on one side and to the cover on the other side.

16. The lighting unit of claim 15 further comprising a hinge connecting the cover to the frame, the hinge allowing the cover to pivot relative to the frame.

17. The lighting unit of claim 13 wherein the first angle is 0° and the second angle is 180° when the cover is in the closed position and the first angle increases and the second angle decreases as the cover pivots to the open position.

18. The lighting unit of claim 1 wherein the activation means deactivates the illumination lamp when the cover is in the closed position and activates the illumination lamp when the cover is moved from the closed position.

* * * * *